US008197198B2

(12) United States Patent
Miyabara et al.

(10) Patent No.: US 8,197,198 B2
(45) Date of Patent: Jun. 12, 2012

(54) FAN SYSTEM

(75) Inventors: Yoshinori Miyabara, Nagano (JP); Jiro Watanabe, Nagano (JP); Hiromitsu Kuribayashi, Nagano (JP)

(73) Assignee: Sanyo Denki Co., Ltd., Tokyo (JP)

( * ) Notice: Subject to any disclaimer, the term of this patent is extended or adjusted under 35 U.S.C. 154(b) by 501 days.

(21) Appl. No.: 12/470,973

(22) Filed: May 22, 2009

(65) Prior Publication Data

US 2009/0290984 A1 Nov. 26, 2009

(30) Foreign Application Priority Data

May 26, 2008 (JP) ..... 2008-137099
Jan. 6, 2009 (JP) ..... 2009-000763

(51) Int. Cl.
*F04D 29/54* (2006.01)

(52) U.S. Cl. ..... 415/199.5; 415/209.1

(58) Field of Classification Search ..... 415/199.4, 415/199.5, 209.1, 214.1
See application file for complete search history.

(56) References Cited

U.S. PATENT DOCUMENTS

| | | | | |
|---|---|---|---|---|
| 6,663,342 | B2 * | 12/2003 | Huang et al. | 415/121.2 |
| 6,799,942 | B1 * | 10/2004 | Tzeng et al. | 415/61 |
| 7,156,611 | B2 * | 1/2007 | Oosawa et al. | 415/68 |
| 2005/0008478 | A1 * | 1/2005 | Chang et al. | 415/149.2 |
| 2007/0231145 | A1 | 10/2007 | Jin | |
| 2008/0138201 | A1 * | 6/2008 | Lin et al. | 415/211.2 |
| 2009/0060732 | A1 * | 3/2009 | Hsu et al. | 415/208.1 |

FOREIGN PATENT DOCUMENTS

JP 2007-263004 10/2007

* cited by examiner

*Primary Examiner* — Edward Look
*Assistant Examiner* — Andrew C Knopp
(74) *Attorney, Agent, or Firm* — Rankin, Hill & Clark LLP

(57) ABSTRACT

A fan system with enhanced air flow-static pressure characteristics and reduced fan noise compared to the related art is provided. The number of duct blades of a duct is the same as the number of stationary blades of an axial flow fan located in front of the duct, and the duct blades correspond to the stationary blades respectively. An end surface of a rear end portion of each stationary blade and an end surface of a front portion of a duct blade corresponding to the stationary blade have the same shape, and they align together and contact each other to form one composite stationary blade, with a discharge port of each axial flow fan communicating with an inlet port of a duct housing located behind the axial flow fan.

6 Claims, 15 Drawing Sheets

Fig.12 [Prior Art]
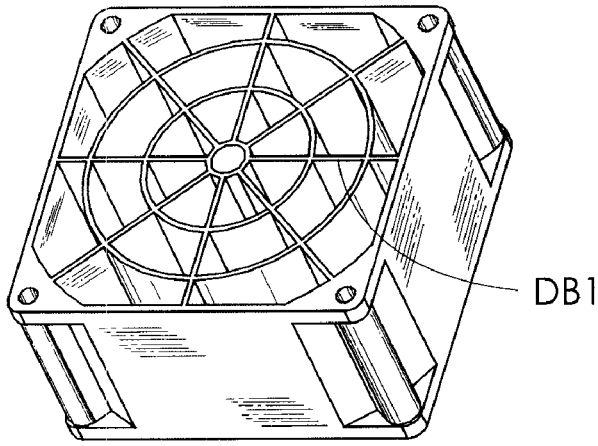
Fig.13 [Prior Art]
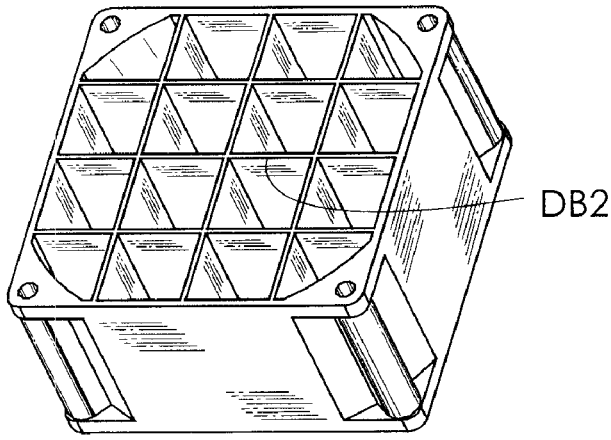

FAN SYSTEM

BACKGROUND OF THE INVENTION

1. Field of the Invention

The present invention relates to a fan system including axial flow fans and ducts interposed therebetween.

2. Description of the Related Art

Japanese Patent Application Publication No. 2007-263004 (JP2007-263004A) discloses a fan system including a front axial flow fan, a rear axial flow fan, and a duct interposed between the axial flow fans. The axial flow fans each include a cylindrical housing body formed with an air channel having a suction port and a discharge port. The housing body includes four support portions that connect a motor and the housing body in the discharge port. The duct has a cylindrical duct housing. The duct housing includes eight duct blades disposed at intervals in a circumferential direction inside the duct housing and extending radially. The duct blades have the shape of a flat plate extending straight.

A conventional fan system, however, has limitations in increasing the static pressure relative to the air flow (the air flow-static pressure characteristics) and reducing fan noise.

SUMMARY OF THE INVENTION

An object of the present invention is to provide a fan system with enhanced air flow-static pressure characteristics and reduced fan noise compared to the related art.

Another object of the present invention is to provide a fan system capable of transforming an air flow that has entered a duct as a vortex flow into a laminar flow to be discharged, even if the axial length of the duct is reduced.

In a fan system of which improvement is aimed by the present invention, n or more axial flow fans and n-1 ducts are alternately disposed on the same axis (n is an integer of 2 or more). According to the present invention, the n or more axial flow fans each include a fan housing, a motor and an impeller. The fan housing includes a housing body formed with an air channel having a suction port and a discharge port, a motor case centrally disposed of the discharge port, and a plurality of stationary blades located in the discharge port and disposed at intervals in a circumferential direction of the axis. The plurality of stationary blades connect the motor case and the housing body. The motor is supported by the motor case. The impeller is disposed between the suction port and the motor case to be rotated by the motor. The n-1 ducts each include a duct housing having an inlet port on the front side thereof and an outlet port on the rear side thereof, and a plurality of duct blades disposed at intervals in the circumferential direction inside the duct housing and extending in an axial direction. The plurality of duct blades of each duct is equal in number to the plurality of stationary blades of the axial flow fan located in front of the duct as viewed from the air suction port of the axial flow fan. The duct blades correspond to the stationary blades respectively. An end surface of the rear end portion of each stationary blade and an end surface of the front portion of the duct blade corresponding to the stationary blade have the same shape, and they align together and contact each other to form one composite stationary blade, with the discharge port of each axial flow fan communicating with the inlet port of the duct housing located behind the axial flow fan.

In the present invention, the plurality of duct blades of a duct is equal in number to the plurality of stationary blades of an axial flow fan located in front of the axial flow fan, so that one stationary blade and one duct blade correspond to each other to form one composite stationary blade. Thus, the plurality of stationary blades of the axial flow fan are extended by the plurality of duct blades. According to the present invention, the stationary blades can be fully utilized to enhance the air flow-static pressure characteristics of the fan system compared to the related art. In addition, fan noise can be reduced.

Preferably, each duct blade may be shaped to transform a vortex flow into a substantially laminar flow without reducing the flow rate in the duct so that a substantially laminar air flow is discharged from the outlet port. With this configuration, air can be smoothly sucked from a duct into an axial flow fan behind the duct, reducing the energy loss of the flowing air and suppressing a decrease in wind pressure and air flow.

In order to obtain a substantially laminar flow discussed above, the following configuration may be adopted, for example. The plurality of stationary blades of the axial flow fan located in front of the duct may each have a rear end portion located in one direction of the axis and a front end portion located in the other direction of the axis. The front end portion may be shifted with respect to the rear end portion in a direction opposite to a rotational direction of the impeller. Each stationary blade may be curved to form a convex surface in the rotational direction of the impeller from the motor case toward the housing body. Each stationary blade may be shaped such that a cross section of the stationary blade taken in the direction perpendicular to the direction from the motor case toward the housing body is curved to form a convex surface in the rotational direction. With this configuration, the velocity of an air flow discharged from the discharge port can be averaged over the entire possible range, which results in an increased air flow and reduced fan noise.

Preferably, the front portion of each duct blade may be shaped such that the cross section of the duct blade is an extension of the cross section of the corresponding stationary blade as the duct blade is viewed in cross section taken in the perpendicular direction, and the rear portion of each duct blade may be shaped such that a tangent plane to a surface of the rear portion located in the rotational direction includes a tangent line extending in parallel to the axis. With this configuration, the rear portion of each duct blade of a duct can produce an air flow that flows into an axial flow fan behind the duct generally in parallel to the axis.

The duct housing may include a cylindrical body coupled to the housing body of the fan housing, and a core concentrically disposed inside the cylindrical body. In this configuration, one end of each of the duct blades may be fixed to the inner periphery of the cylindrical body and the other end of each of the duct blades may be fixed to the outer periphery of the core. One or more auxiliary duct blades may be provided between two adjacent duct blades in a region in which the rear portion of each duct blade is located, and the auxiliary duct blades extend inwardly of the cylindrical body from the peripheral wall portion of the cylindrical body and extend in the axial direction from the outlet port toward the inlet port of the duct housing. With this configuration, an air flow that has entered a duct as a vortex flow can be transformed and be discharged as a laminar flow, even if the axial length of the duct is reduced. Accordingly, it is possible to produce a laminar flow that flows into an axial flow fan on the rear side generally in parallel to the axis. As a result, it is possible to reduce a drop in static pressure at an inflection portion of the air flow-static pressure characteristics (at which the static pressure drops greatly), improving the air flow-static pressure characteristics.

The length of each auxiliary duct blade in the axial direction may be the same as the length of the rear portion of each duct blade in the axial direction. With this configuration, a laminar flow that flows into an axial flow fan on the rear side can be produced with the minimum length of each auxiliary duct blade in the axial direction.

The inner peripheral surface of the peripheral wall portion of the cylindrical portion may include first and second surfaces extending in parallel to each other and third and fourth surfaces extending in parallel to each other and perpendicularly to the first and second surfaces. In this configuration, preferably, the one or more auxiliary duct blades extend perpendicularly to the first through fourth surfaces. With this configuration, a large space for air to flow through can be secured between each auxiliary duct blade and the rear portion of a duct blade adjacent to the auxiliary duct blade, or between two adjacent auxiliary duct blades.

Preferably, the plurality of auxiliary duct blades are formed integrally with each of the first through fourth surfaces of the cylindrical body, extending in parallel to each other. With this configuration, the plurality of auxiliary duct blades can be designed easily.

When the n is an integer of 3 or more, all the n axial flow fans may have the same shape and all the n-1 ducts may have the same shape. With this configuration, desired numbers of axial flow fans and ducts can be suitably combined according to an application, providing a fan system with desired characteristics at a low cost.

BRIEF DESCRIPTION OF THE DRAWINGS

FIG. 12 is a perspective view of a fan system according to Comparative Example 1 subjected to the test shown in FIG. 11.

FIG. 13 is a perspective view of a fan system according to Comparative Example 2 subjected to the test shown in FIG. 11.

DESCRIPTION OF THE PREFERRED EMBODIMENTS

Figure 1:
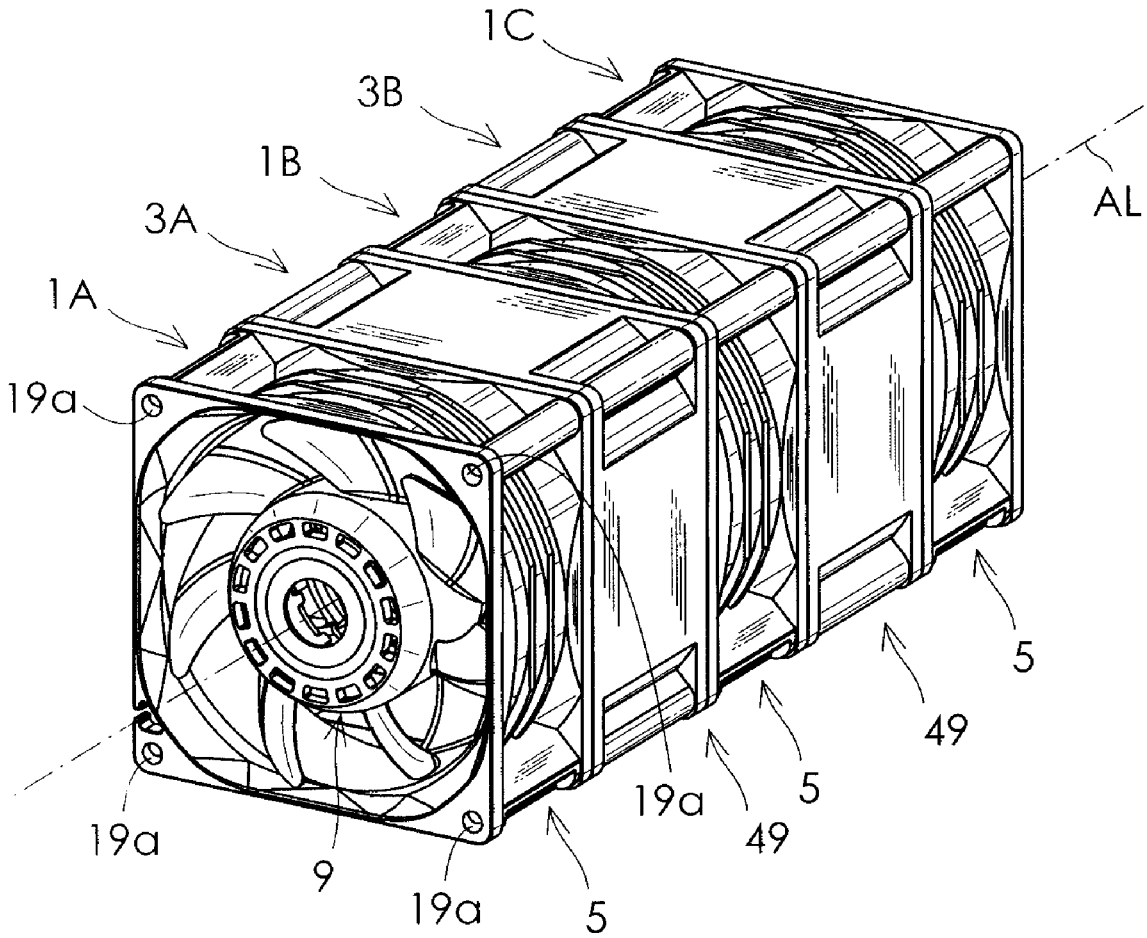
FIG. 1 is a perspective view of a fan system according to an embodiment of the present invention.
Figure 2:
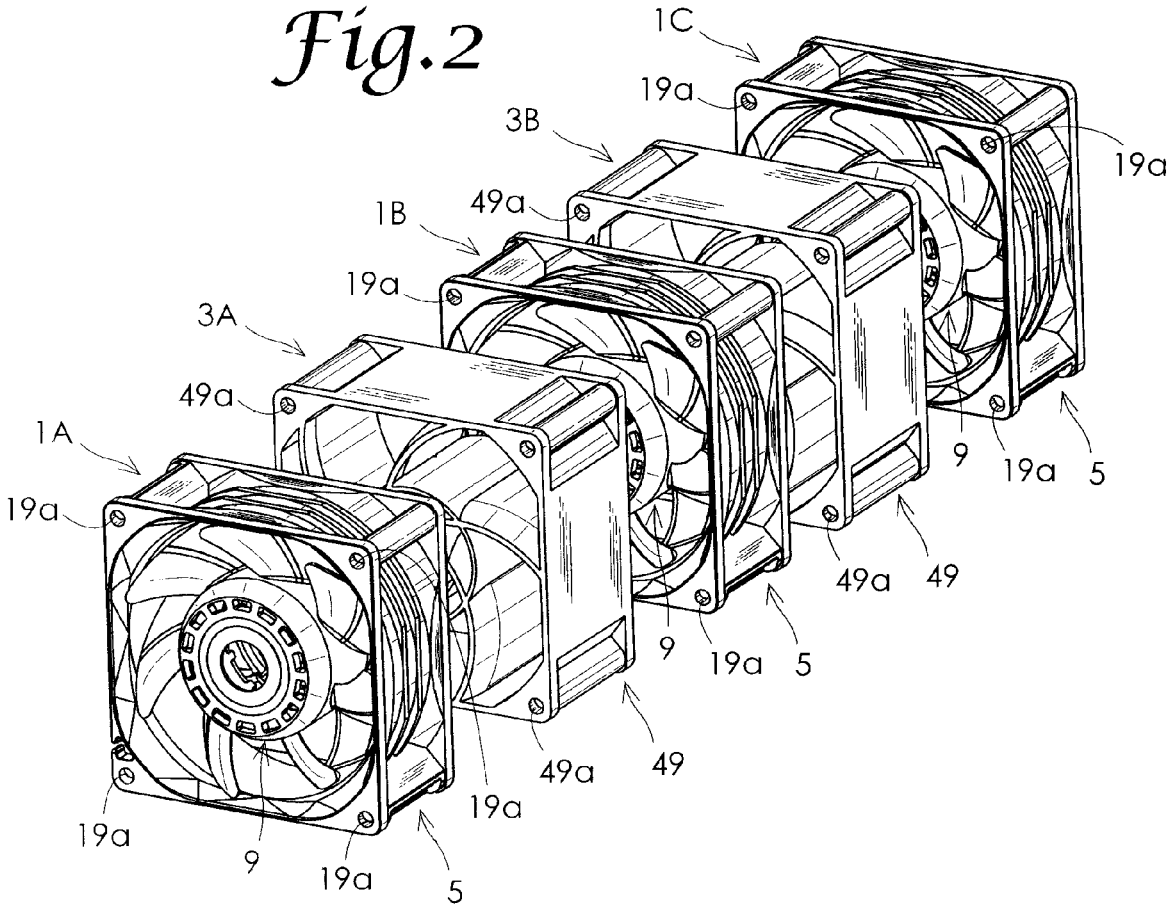
FIG. 2 is an exploded perspective view of the fan system shown in FIG. 1.

An embodiment of the present invention will be hereinafter described in detail with reference to the drawings. FIG. 1 is a perspective view of a fan system according to an embodiment of the present invention. FIG. 2 is an exploded perspective view of the fan system shown in FIG. 1. As shown in the figures, the fan system according to this embodiment includes n axial flow fans 1A to 1C (n is an integer of 2 or more, which is 3 in this embodiment), and n-1 (2 in this embodiment) ducts 3A and 3B, which are alternately disposed on the same axis AL. The axial flow fans 1A to 1C have the same structure, and the ducts 3A and 3B have the same structure. In the fan system according to this embodiment, air is flown in the direction from the axial flow fan 1A toward the axial flow fan 1C. For the duct 3A, thus, the axial flow fan 1A works as an axial flow fan disposed on the front side and the axial flow fan 1B works as an axial flow fan disposed on the rear side. For the duct 3B, the axial flow fan 1B works as an axial flow fan disposed on the front side and the axial flow fan 1C works as an axial flow fan disposed on the rear side. In other words, the duct 3A is disposed between the axial flow fan 1A in front of it and the axial flow fan 1B behind it to fill a gap between the axial flow fan 1A and the axial flow fan 1B, and the duct 3B is disposed between the axial flow fan 1B in front of it and the axial flow fan 1C behind it to fill a gap between the axial flow fan 1B and the axial flow fan 1C.

Figure 3:
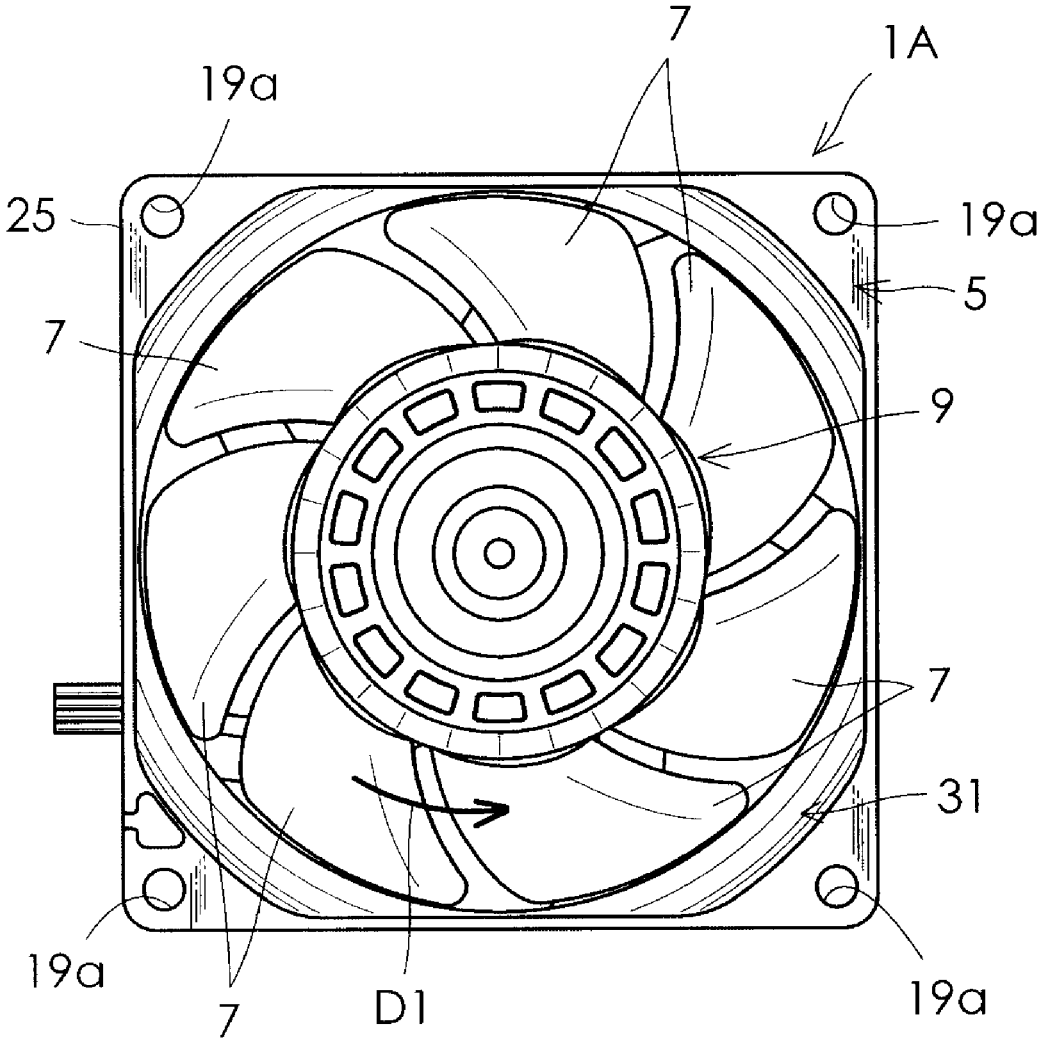
FIG. 3 is a front view of an axial flow fan for use in the fan system shown in FIG. 1.
Figure 4:
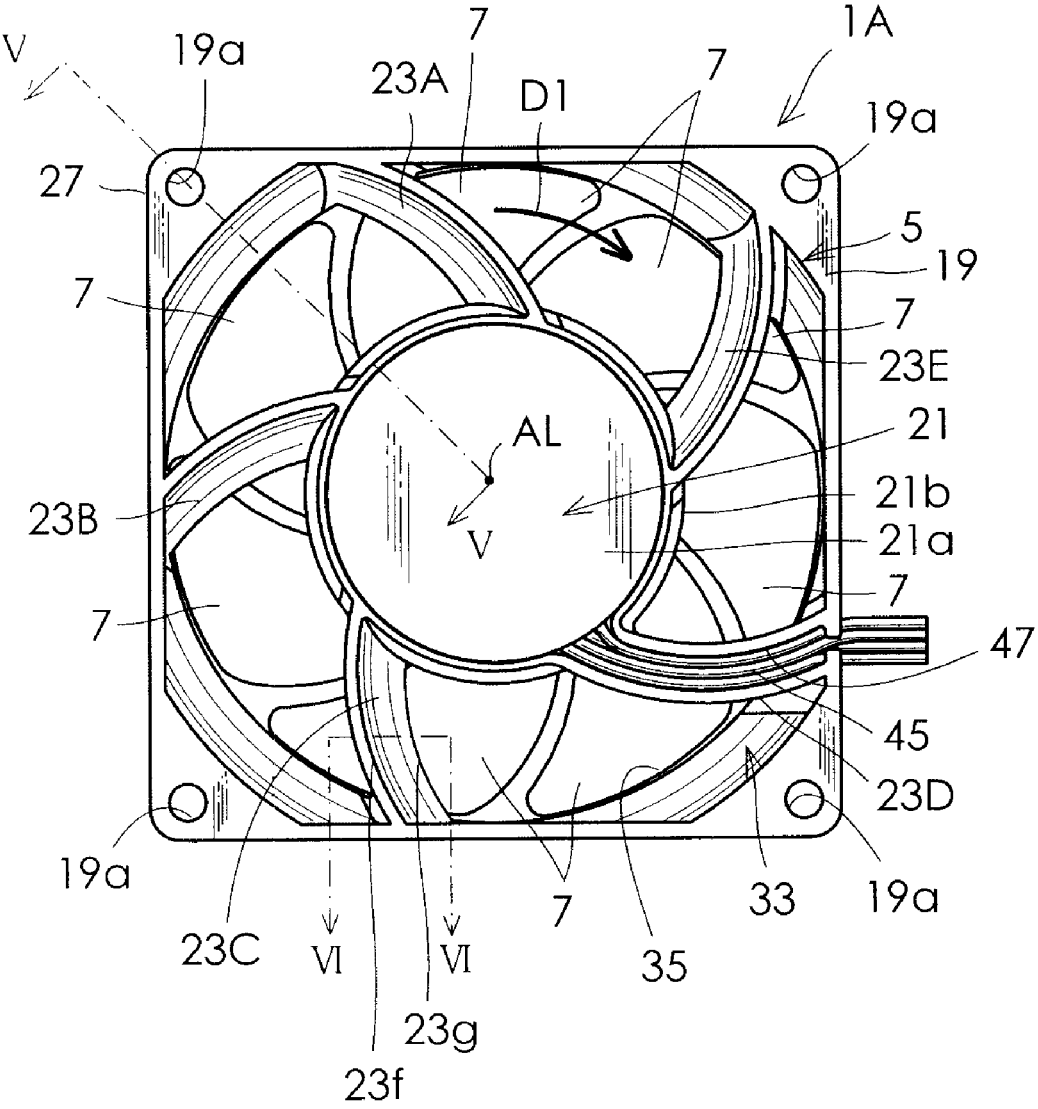
FIG. 4 is a back view of the axial flow fan for use in the fan system shown in FIG. 1.
Figure 5:
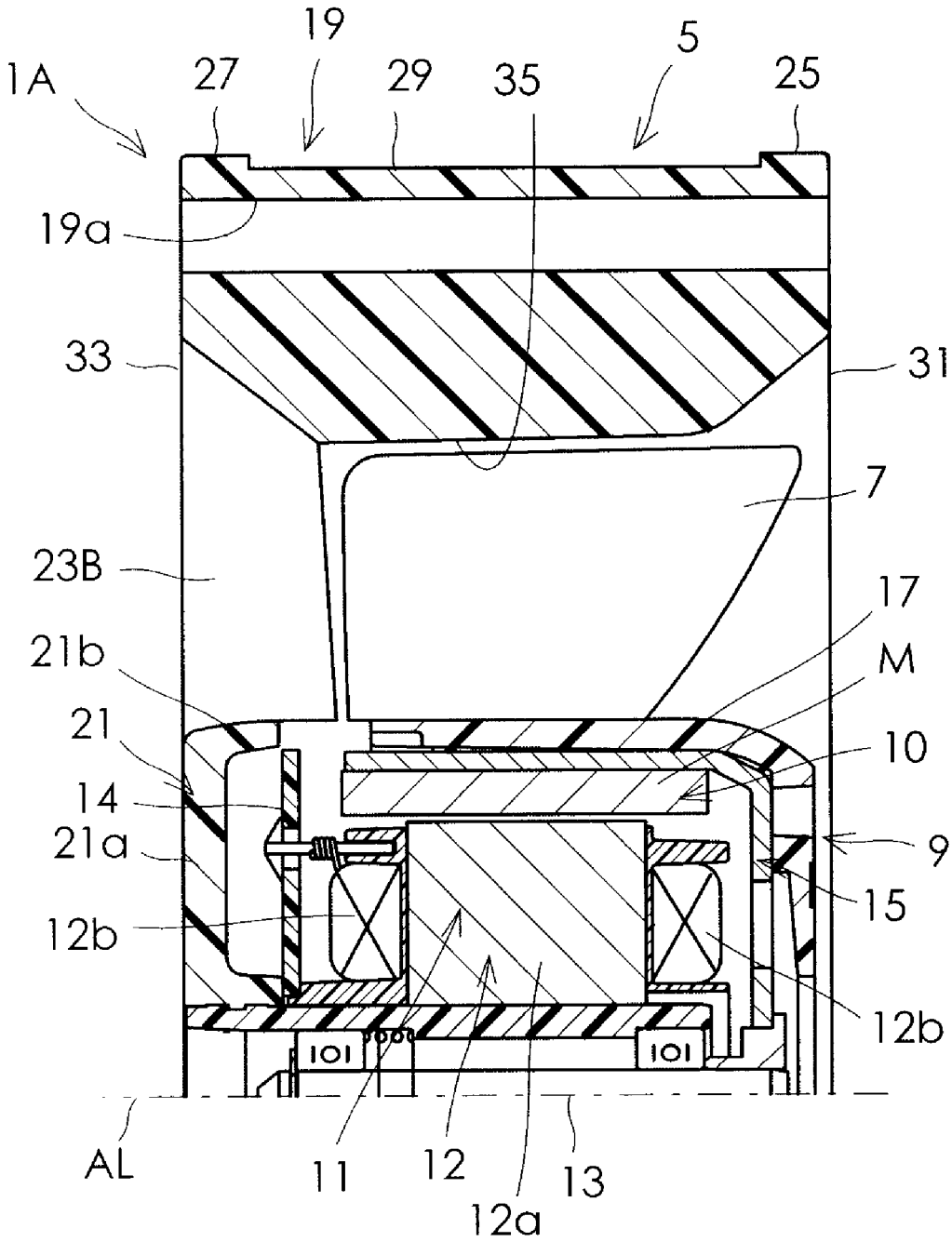
FIG. 5 is a cross-sectional view taken along line V-V of FIG. 4.
Figure 6:
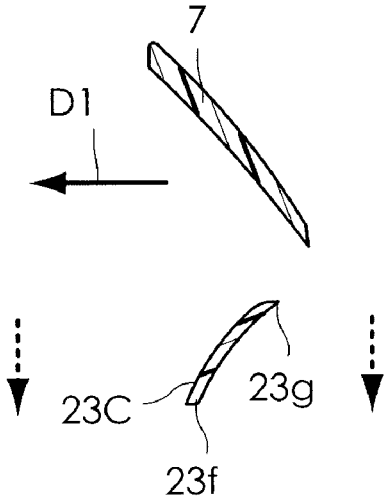
FIG. 6 is a cross-sectional view taken along line VI-VI of FIG. 4.

Now, the structure of one axial flow fan (1A) of the axial flow fans 1A to 1C will be described. FIGS. 3 and 4 are a front view and a back view, respectively, of the axial flow fan 1A. FIGS. 5 and 6 are a cross-sectional view taken along line V-V and a cross-sectional view taken along line VI-VI, respectively, of FIG. 4. In the figures, the axial flow fan 1A includes a fan housing 5, an impeller 9 having seven rotary blades 7 and disposed in the fan housing 5, and a motor 11. As shown in FIG. 5, the motor 11 has a rotor 10 on which the impeller 9 is mounted, and a stator 12. The rotor 10 is constructed by fixing a plurality of permanent magnets M to the inner side of the peripheral wall portion of a cup-shaped member 15 fixed to a rotary shaft 13. The stator 12 is constructed by winding an excitation winding 12*b* around a stator core 12*a*.

The impeller 9 has the seven rotary blades 7 and a rotary blade fixing member 17. The rotary blade fixing member 17 has the shape of a cup, to the peripheral wall portion of which the seven rotary blades 7 are fixed. The cup-shaped member 15 is fixed to the inner side of the peripheral wall portion of the rotary blade fixing member 17.

The fan housing 5 has a housing body 19, a motor case 21, and five stationary blades 23A to 23E (FIG. 4) connecting the motor case 21 and the housing body 19. The motor case 21 houses a part of the stator 12, and a circuit substrate 14 on which an excitation circuit for supplying an excitation current to the excitation winding 12*b* is mounted. The motor case 21 is centrally disposed in a discharge port 33 to be described later, and has a bottom wall portion 21*a* and a peripheral wall portion 21*b* formed continuously with the bottom wall portion 21*a* and extending toward a suction port 31 to be described later.

The housing body 19 has an annular suction port flange 25 on one end in the direction in which the axis AL of the rotary shaft 13 extends (in the axial direction), and an annular discharge port flange 27 on the other end in the axial direction. The housing body 19 also has a cylindrical portion 29 between the flanges 25 and 27. The internal spaces of the suction port flange 25, the cylindrical portion 29 and the discharge port flange 27 form an air channel 35 having a suction port 31 and a discharge port 33 or both sides. A through hole 19*a* for receiving a mounting screw is formed at each of the four corners of the housing body 19.

As shown in FIG. 4, the five stationary blades 23A to 23E are disposed at intervals in a circumferential direction of the rotary shaft 13 and located in the discharge port 33 of the air channel 35. One stationary blade 23D, of the five stationary blades 23A to 23E, has a groove 47 for housing therein a plurality of lead wires 45 for supplying electricity to the excitation windings of the stator 12. The groove 47 opens toward the discharge port 33. As shown in FIGS. 4 and 6, the stationary blades 23A to 23E each have a rear end portion 23*f* located in one axial direction and a front end portion 23*g* located in the other axial direction. As shown in FIG. 6, the front end portion 23*g* is shifted with respect to the rear end portion 23*f* in the direction opposite to a rotational direction of the impeller 9 (the direction of the arrow D1). Also, as shown in FIG. 4, each of the stationary blades 23A to 23E is curved to form a convex surface in the rotational direction of the impeller 9 (the direction of the arrow D1) from the motor case 21 toward the housing body 19. In addition, the stationary blades 23A to 23E are shaped such that the cross section of each stationary blade taken in a direction perpendicular to the direction from the motor case 21 toward the housing body 19 (the cross section of the stationary blade 23C as seen in FIG. 6) is curved to form a convex surface in the rotational direction (the direction of the arrow D1).

Figure 7:
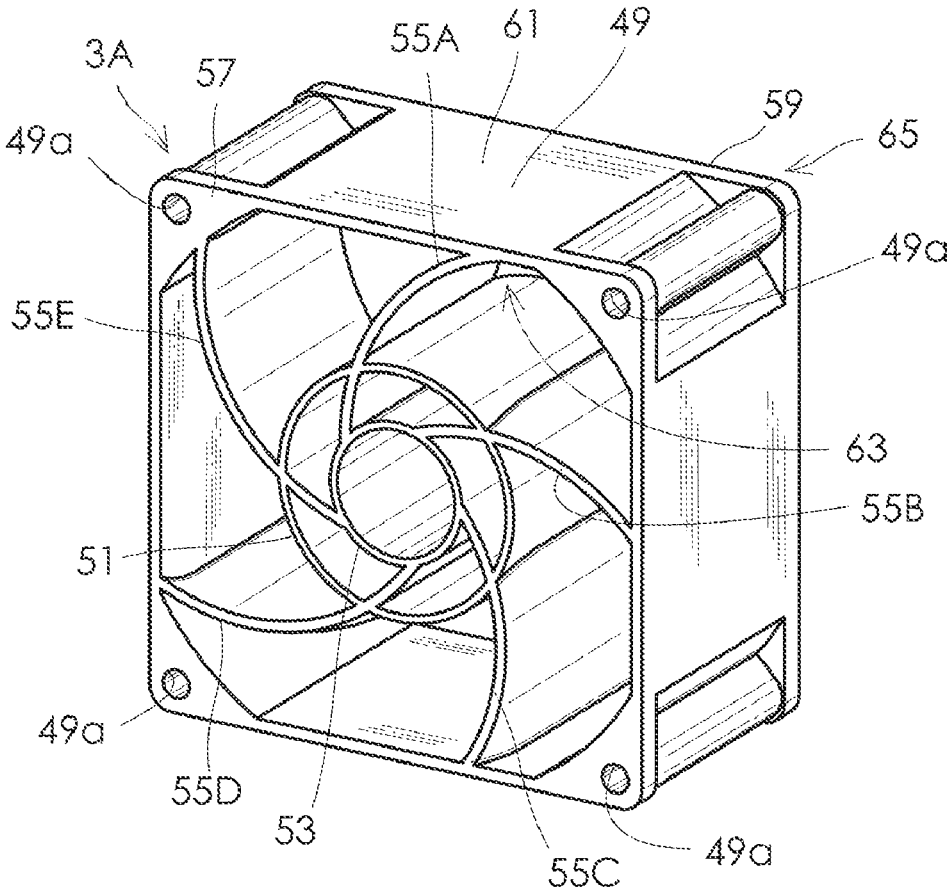
FIG. 7 is a perspective view of a duct for use in the fan system shown in FIG. 1.
Figure 8:
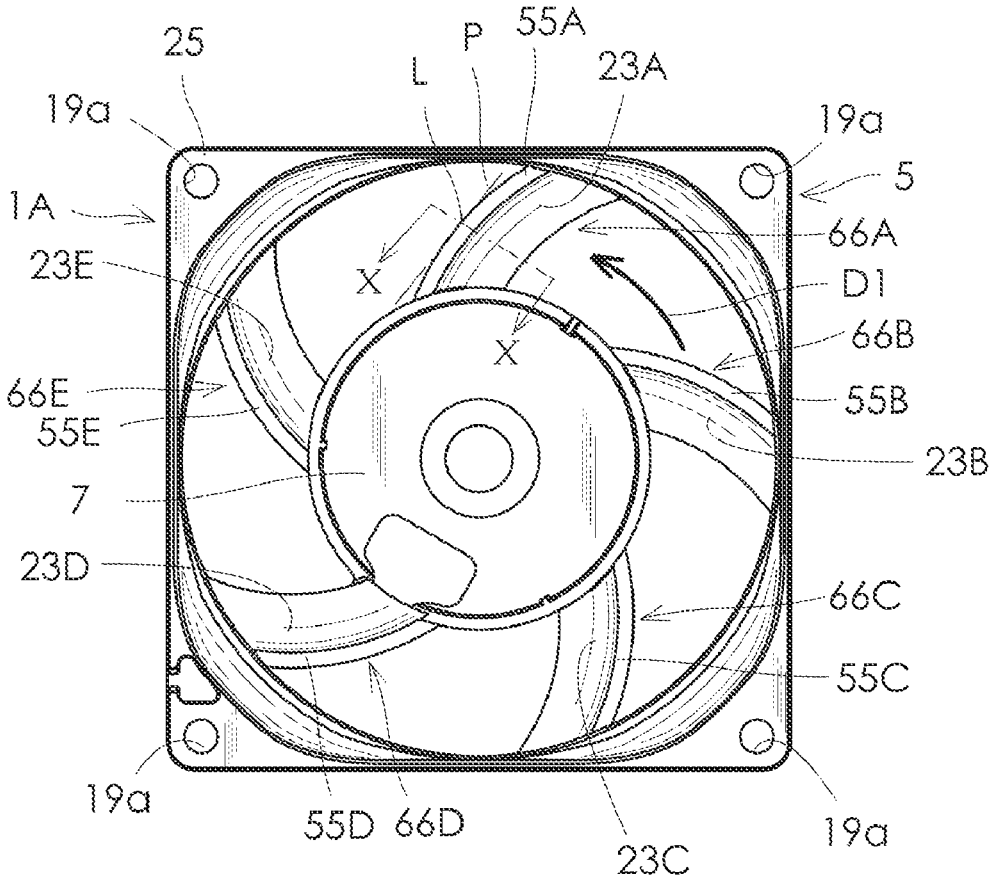
FIG. 8 is a front view of the axial flow fan and the duct for use in the fan system shown in FIG. 1 assembled together, as viewed from the side of the axial flow fan disposed on the front side.
Figure 9:
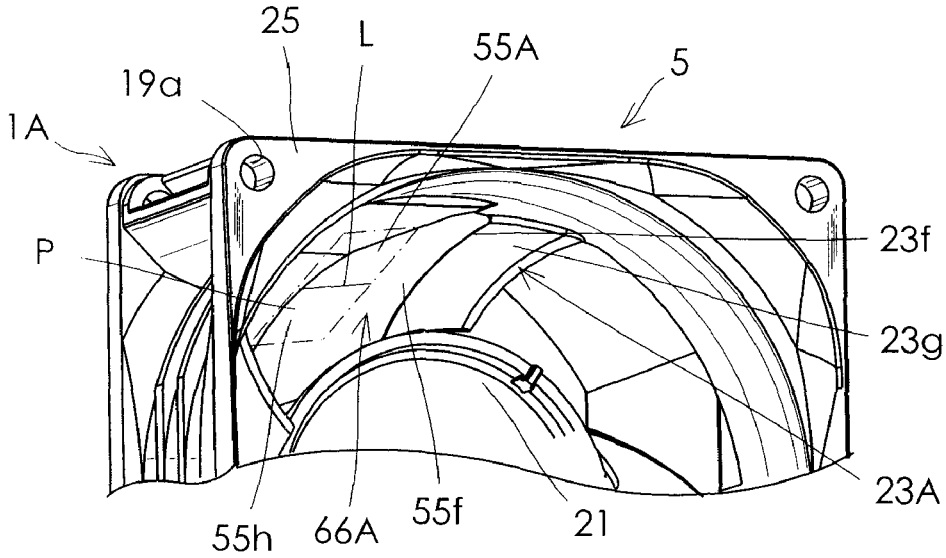
FIG. 9 is a partial perspective view of the axial flow fan and the duct for use in the fan system shown in FIG. 1 assembled together, as viewed from the side of the axial flow fan disposed on the front side.
Figure 10:
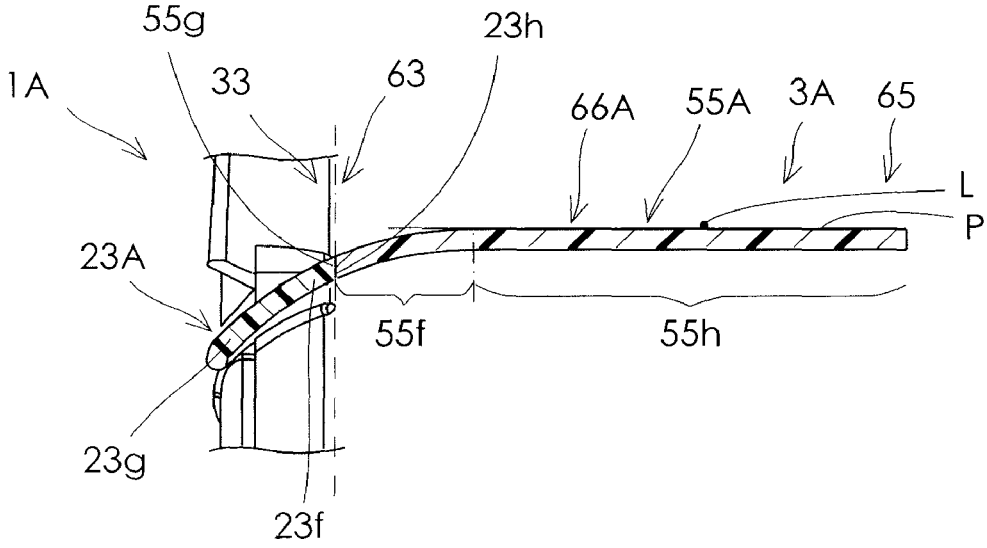
FIG. 10 is a cross-sectional view taken along line X-X of FIG. 8.

Next, the structure of one duct (3A) that has the same shape as that of the duct 3B will be described. FIG. 7 is a perspective view of the duct 3A. FIGS. 8 and 9 are a front view and a partial perspective view, respectively, of the axial flow fan 1A and the duct 3A assembled together, as viewed from the side of the axial flow fan 1A on the front side. For ease of understanding, the impeller 9 and the motor 11 are not illustrated in FIGS. 8 and 9. FIG. 10 is a cross-sectional view taken along line X-X of FIG. 8. As shown in FIG. 7, the duct 3A has a duct housing 49 and five duct blades 55A to 55E. The duct housing 49 includes a cylindrical body 61 and two cores 51 and 53 disposed inside the cylindrical body 61 for reinforcement. The cylindrical body 61 has an annular inlet port flange 57 at a front portion facing the axial flow fan 1A on the front side, and an annular outlet port flange 59 at a rear portion facing the axial flow fan 1B on the rear side. With this configuration, the duct housing 49 has an inlet port 63 on the front side and an outlet port 65 on the rear side. A through hole 49*a* for receiving a mounting screw is formed at each of the four corners of the duct housing 49. The inlet port flange 57 contacts the discharge port flange 27 of the axial flow fan 1A on the front side with the inlet port 63 of the duct housing 49 communicating with the discharge port 33 of the axial flow fan 1A on the front side. Also, the outlet port flange 59 contacts the suction port flange 25 of the axial flow fan 1B on the rear side with the outlet port 65 of the duct 3A communicating with the suction port 31 of the axial flow fan 1B on the rear side. With the axial flow fans 1A to 1C and the ducts 3A and 3B contacting each other in this way, the fan system is attached to an appropriate location by means of mounting screws inserted into the through holes 19*a* of the axial flow fans 1A to 1C and the through holes 49*a* of the ducts 3A and 3B.

The cores 51 and 53 are concentrically disposed in the cylindrical body 61 about the axis AL (FIG. 5) of the rotary shaft 13, and both have a cylindrical shape. The diameter of the core 51 is larger than that of the core 53 but slightly smaller than the outer diameter of the motor case 21.

The five duct blades 55A to 55E connect the core 53, the core 51, and the duct housing 49. One end of each of the five duct blades 55A to 55E is fixed to the inner periphery of the cylindrical body 61, and the other end of each of the duct blades 55A to 55E is fixed to the outer periphery of the core 53. The duct blades 55A to 55E are disposed at intervals in the circumferential direction of the axis AL and extend in the axial direction. As shown in FIGS. 8 to 10, the number of the duct blades 55A to 55E (five) is equal to the number of the stationary blades 23A to 23E (five) of the axial flow fan 1A located on the front side. The duct blades 55A to 55E are disposed to correspond to the stationary blades 23A to 23E, respectively. The stationary blades 23A to 23E contact the corresponding duct blades 55A to 55E to form composite stationary blades 66A to 66E, respectively. That is, taking up the duct blade 55A shown in FIG. 10 as an example, an end surface 23*h* of the rear end portion 23*f* of the stationary blade 23A and an end surface 55*g* of the front portion 55*f* of the duct blade 55A corresponding to the stationary blade 23A contact each other to form one composite stationary blade 66A, with the discharge port 33 of the axial flow fan 1A communicating with the inlet port 63 of the duct housing 49 located behind the axial flow fan 1A. The front portion 55*f* of the duct blade 55A is shaped such that the cross section of the duct blade 55A is an extension of the cross section of the stationary blade 23A as the duct blade 55A is viewed in cross section taken in the perpendicular direction. That is, the front portion 55*f* of the duct blade 55A is shaped to align with an imaginary extension of the stationary blade 23A that would be obtained by extending the curved stationary blade 23A in such a way as to maintain the curved shape. The front portions of the other duct blades 55B to 55E are also shaped in the same way. As shown in FIGS. 8 to 10, the rear portion 55*h* of the duct blade 55A is shaped such that a tangent plane P to a surface of the rear portion 55*h* located in the rotational direction D1 includes a tangent line L extending in parallel to the axis. As a result, the front portion 55*f* of each of the duct blades 55A to 55E is terminated and connected to the rear portion 55*h* before the curved front portion 55*f* reaches a location at which it hinders (obstructs) an air flow. The air flow flows generally straight on the rear portions 55*h* of the duct blades 55A to 55E, and flow into the suction port of the axial flow fan 1C. That is, the duct blades 55A to 55E in the ducts 3A and 3B used in this embodiment are shaped to transform a vortex flow into a substantially laminar flow without reducing the flow rate in the duct so that a substantially laminar air flow is discharged from the outlet port 65.

Next, described below are the results of examining the relationship between the air flow and the static pressure using various fan systems to verify the effect of the present invention.

Figure 11:
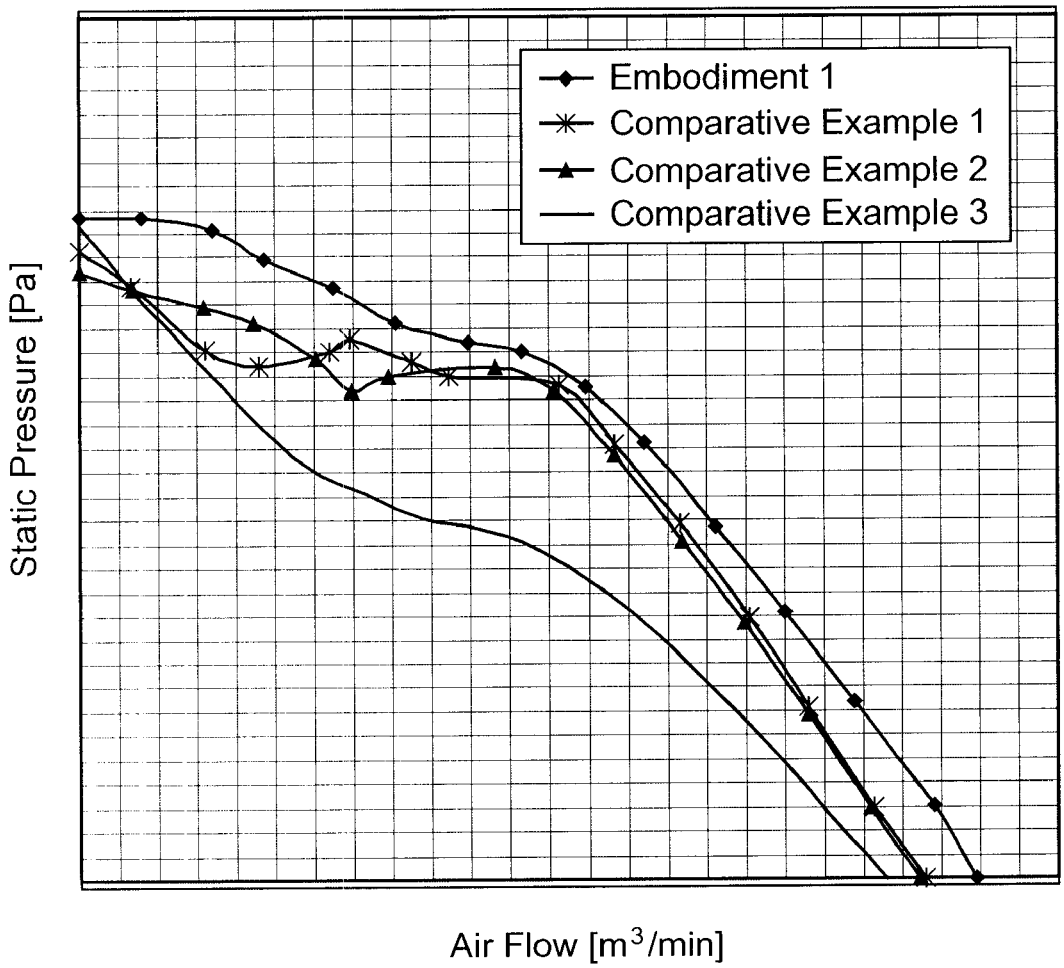
FIG. 11 shows the relationship between the air flow and the static pressure of fan systems subjected to a test.

FIG. 11 shows measurement results. In FIG. 11, EMBODIMENT 1 is the fan system shown in FIGS. 1 to 10. Comparative Example 1 corresponds to a fan system in which duct blades DB1 are each a flat plate extending radially as shown in FIG. 12 but which is otherwise the same as the fan system according to EMBODIMENT 1. Comparative Example 2 corresponds to a fan system in which duct blades DB2 are disposed in a grid pattern as shown in FIG. 13 but which is otherwise the same as the fan system according to EMBODIMENT 1. Comparative Example 3 is a fan system with no ducts being disposed therein. The axial length of the ducts used in the fan systems according to EMBODIMENT 1 and Comparative Examples 1 and 2 was set to 43 mm. As shown in FIG. 11, the static pressure was high relative to the air flow (the air flow-static pressure characteristics were enhanced) with the fan system according to EMBODIMENT 1 compared to the fan systems according to Comparative Examples 1 to 3. When noise was measured with the four fan systems, noise produced by the fan system according to EMBODIMENT 1 was lower than noise produced by the fan systems according to Comparative Examples 1 to 3.

Figure 14:
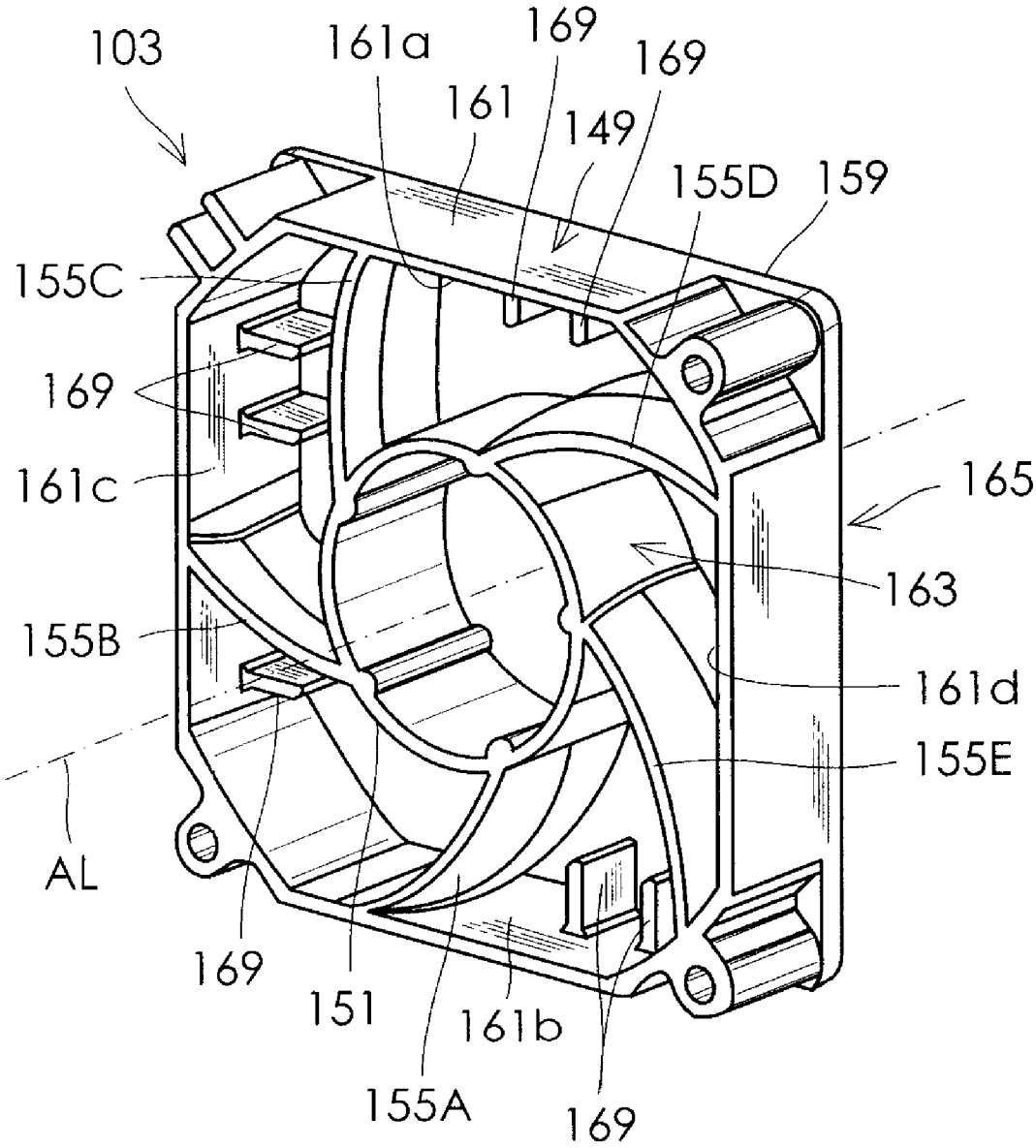
FIG. 14 is a perspective view of a duct for use in a fan system according to another embodiment of the present invention.
Figure 15:
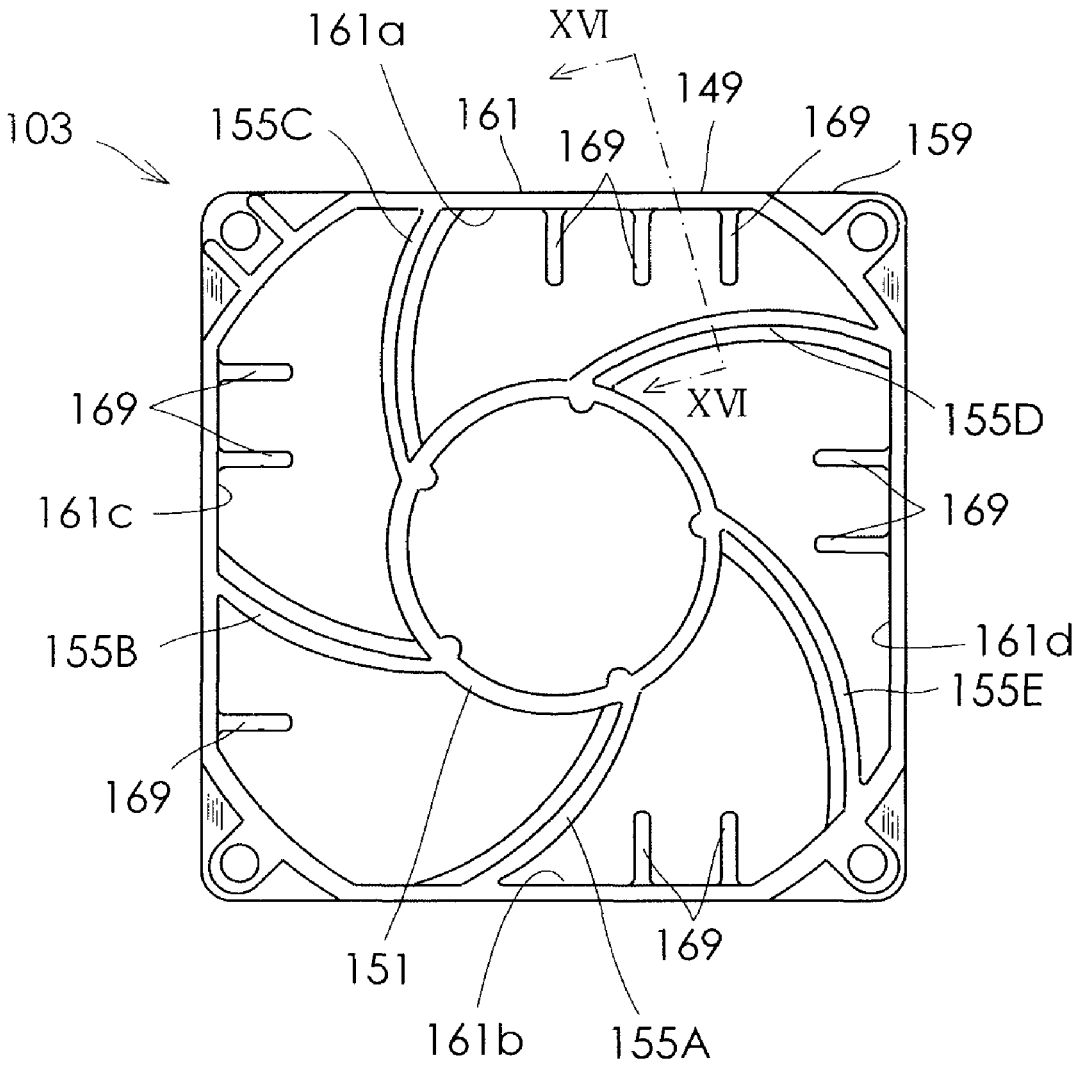
FIG. 15 is a front view of the duct shown in FIG. 14.
Figure 16:
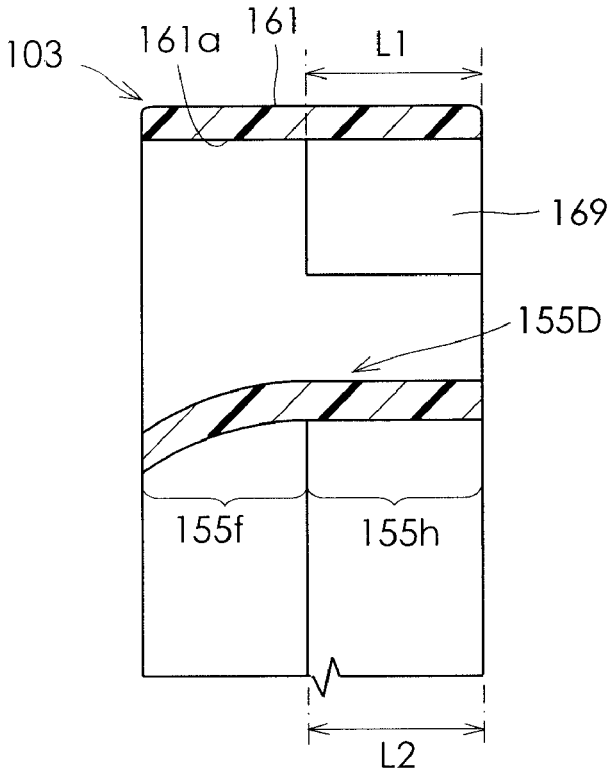
FIG. 16 is a cross-sectional view taken along line XVI-XVI of FIG. 15.

FIGS. 14 and 15 are a perspective view and a front view, respectively, of a duct for use in a fan system according to another embodiment of the present invention. FIG. 16 is a cross-sectional view taken along line XVI-XVI of FIG. 15. The fan system according to this embodiment has the same structure as that of the fan system shown in FIGS. 1 to 10 except for the duct structure. Thus, components with the same structure (the axial flow fans 1A to 1C) are not described here. As shown in FIGS. 14 and 15, the fan system according to this embodiment includes a duct 103 having a duct housing 149 and five duct blades 155A to 155E. The duct housing 149 includes a cylindrical body 161 and a core 151 disposed inside the cylindrical body 161 for reinforcement. The cylindrical body 161 has a flange 159 facing an axial flow fan (1B) one the rear portion. The cylindrical body 161 has the shape of a rectangular cylinder. The inner peripheral surface of the peripheral wall portion of the cylindrical portion 161 includes first and second surfaces 161*a* and 161*b* extending in parallel to each other and third and fourth surfaces 161*c* and 161*d* extending in parallel to each other and perpendicularly to the first and second surfaces 161*a* and 161*b*. With this configuration, the duct housing 149 has an inlet port 163 on the front side and an outlet port 165 on the rear side. The axial length of the ducts used in this embodiment (the axial length of the duct housing 149) is half the axial length of the ducts shown in FIGS. 7 to 9 or less (20 mm).

One end of each of the five duct blades 155A to 155E is fixed to the inner periphery of the cylindrical body 161, and the other end of each of the duct blades 155A to 155E is fixed to the outer periphery of the core 151. The duct blades 155A to 155E are disposed at intervals in the circumferential direction of the axis AL and extend in the axial direction. As shown in FIG. 16, the duct blades 155A to 155E each have a front portion 155*f* and a rear portion 155*h*. The five duct blades 155A to 155E have the same structure as that of portions of the duct blades 55A to 55E shown in FIGS. 7 to 9 on the radially outer side with respect to the core 51. The number of the duct blades 155A to 155E (five) is equal to the number of the stationary blades located on the front side. The duct blades 155A to 155E are disposed to correspond to the stationary blades, respectively.

Auxiliary duct blades 169 are provided between two duct blades, of the five duct blades 155A to 155E, adjacent in the circumferential direction (155A and 155B), (155B and 155C), (155C and 155D), (155D and 155E) and (155E and 155A) in a region in which the rear portions 155*h* of the duct blades 155A and 155E are located. The auxiliary duct blades 169 each have the shape of a flat rectangular plate, and are formed integrally with the cylindrical body 161 on the first to fourth surfaces 161*a* to 161*d*. In this embodiment, three auxiliary duct blades 169 are formed integrally on the first surface 161*a*, two auxiliary duct blades 169 are formed integrally on the second surface 161*b*, three auxiliary duct blades 169 are formed integrally on the third surface 161*c*, and two auxiliary duct blades 169 are formed integrally on the fourth surface 161*d*. The plurality of auxiliary duct blades 169 formed on each surface (161*a* to 161*d*) extend perpendicularly to the surface (161*a* to 161*d*) and in parallel to each other. The auxiliary duct blades 169 extend inwardly of the cylindrical body 161 from the peripheral wall portion of the cylindrical body 161, and extend in the direction of the axis AL from the outlet port 165 toward the inlet port 163 of the duct housing 149. As shown in FIG. 16, an axial length L1 of the auxiliary duct blades 169 is the same as an axial length L2 of the rear portion 155*h* of the duct blades 155A to 155E.

Figure 17:
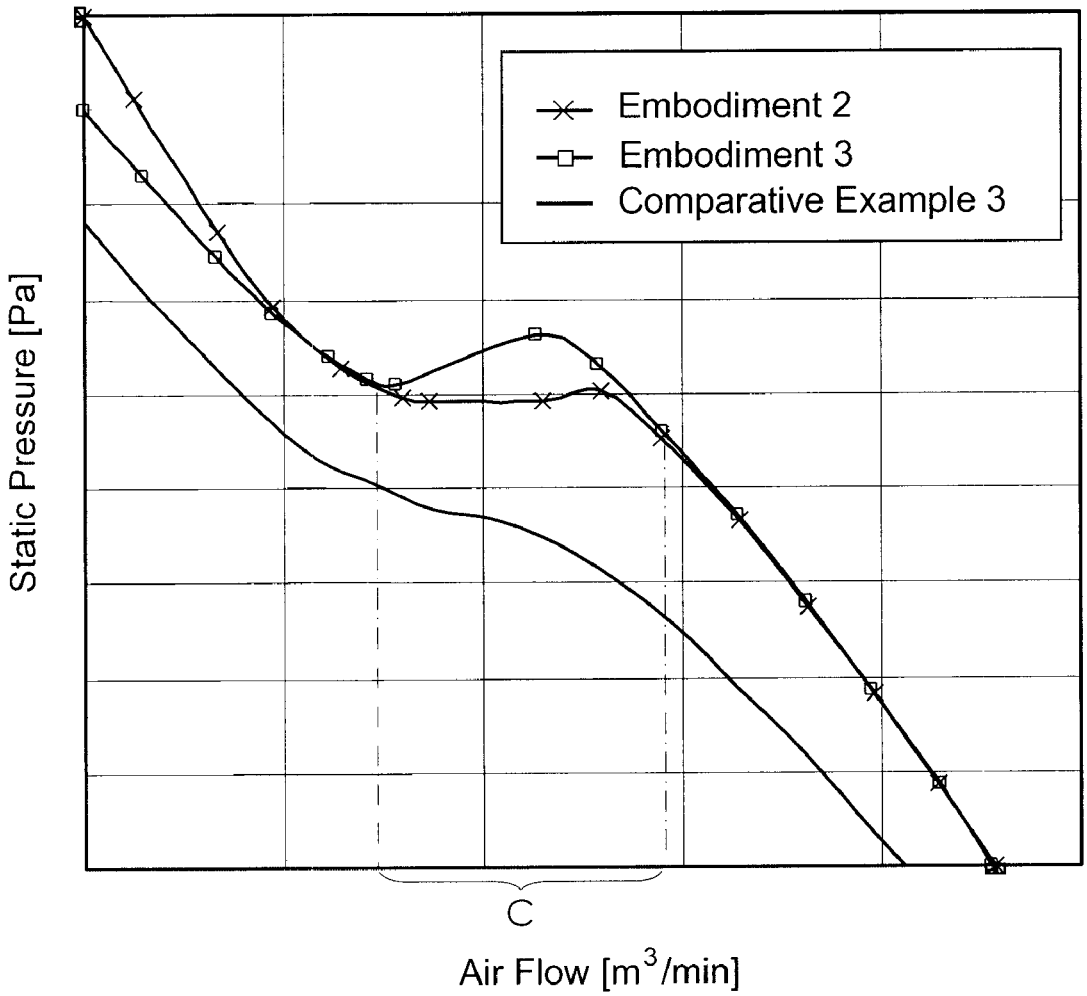
FIG. 17 shows the relationship between the air flow and the static pressure of fan systems subjected to a test.

Next, described below are the results of examining the relationship between the air flow and the static pressure using various fan systems to verify the effect of the fan system according to this embodiment. FIG. 17 shows measurement results. In FIG. 17, either of EMBODIMENTs 2 and 3 is a fan system including three axial flow fans and two ducts alternately disposed. The fan system according to EMBODIMENT 2 uses ducts obtained by removing the auxiliary duct blades 169 from the duct shown in FIGS. 14 to 16. The fan system according to EMBODIMENT 3 uses the duct shown in FIGS. 14 to 16. Comparative Example 3 is a fan system with no ducts being disposed. The axial length of the ducts used in the fan systems according to EMBODIMENTs 2 and 3 was set to 20 mm. All the fan systems according to EMBODIMENTs 2 and 3 and Comparative Example 3 used the same axial flow fans as the axial flow fans 1A to 1C shown in FIGS. 3 and 4. As shown in FIG. 17, the fan system according to EMBODIMENT 3 (with auxiliary duct blades) exhibited a small drop in static pressure (improved air flow-static pressure characteristics) at an inflection portion C (at which the static pressure does not change greatly relative to changes in air flow, or at which the static pressure drops) compared to the fan system according to EMBODIMENT 2 (with no auxiliary duct blades). This is because the auxiliary duct blades 169 allow air to positively flow in the axial direction between the rear portions 155*h* of the duct blades 155A to 155E and the auxiliary duct blades 169 to produce a laminar flow that flows in the axial direction into the axial flow fan on the rear end.

In the present invention, the number of a plurality of stationary blades of an axial flow fan is equal to that of a plurality of duct blades of a duct located behind the axial flow fan, so that a stationary blade and a duct blade correspond to each other to form one composite stationary blade. The plurality of stationary blades of the axial flow fan are extended by the duct blades. According to the present invention, the stationary blades can be fully utilized to improve the air flow-static pressure characteristics of a fan system compared to the related art. In addition, fan noise can be reduced.

Moreover, one or more auxiliary duct blades are provided between two adjacent duct blades in a region in which the rear portion of each duct blade is located, and the auxiliary duct blades extend inwardly of the cylindrical body from the peripheral wall portion of the cylindrical body and also extend in the axial direction from the outlet port toward the inlet port of the duct housing. Consequently, an air flow that has entered a duct as a vortex flow can be transformed and be discharged as a laminar flow, even if the axial length of the duct is reduced. As a result, it is possible to reduce a drop in static pressure at an inflection portion of the air flow-static pressure characteristics (at which the static pressure drops greatly), thereby improving the air flow-static pressure characteristics.

Although the present invention has been described by way of specific embodiments, the present invention is not limited thereto. Rather, it should be understood by those skilled in the art that the present invention may be modified and changed in various ways without departing from the scope and spirit of the present invention.

What is claimed is:

1. A fan system, comprising:

n or more axial flow fans and n-1 ducts that are alternately disposed on the same axis, where n is an integer of 2 or more, the n or more axial flow fans each comprising:

a fan housing including a housing body formed with an air channel having a suction port and a discharge port, a motor case centrally disposed of the discharge port, and a plurality of stationary blades located in the discharge port and disposed at intervals in a circumferential direction of the axis, the plurality of stationary blades connecting the motor case and the housing body;

a motor supported by the motor case; and an impeller disposed between the suction port and the motor case to be rotated by the motor, and the n-1 ducts each comprising:

a duct housing having an inlet port on a front side thereof and an outlet port on a rear side thereof; and a plurality of duct blades disposed at intervals in the circumferential direction inside the duct housing and extending in an axial direction of the axis, the plurality of duct blades of each duct being equal in number to the plurality of stationary blades of the axial flow fan located in front of the duct as viewed from the air suction port of the axial flow fan, the duct blades corresponding to the stationary blades respectively, wherein:

an end surface of a rear end portion of each stationary blade and an end surface of a front portion of the duct blade corresponding to the stationary blade have the same shape, and they align together and contact each other to form one composite stationary blade, with the discharge port of each axial flow fan communicating with the inlet port of the duct housing located behind the axial flow fan;

each duct blade is shaped to transform a vortex flow into a substantially laminar flow without reducing a flow rate in the duct so that a substantially laminar air flow is discharged from the outlet port;

the plurality of stationary blades of the axial flow fan located in front of the duct each have a rear end portion located in one direction of the axis and a front end portion located in the other direction of the axis, the front end portion being shifted with respect to the rear end portion in a direction opposite to a rotational direction of the impeller, each stationary blade being curved to form a convex surface in the rotational direction of the impeller from the motor case toward the housing body, and each stationary blade being shaped such that a cross section of the stationary blade taken in a direction perpendicular to a direction from the motor case toward the housing body is curved to form a convex surface in the rotational direction;

the front portion of each duct blade is shaped such that a cross section of the duct blade is an extension of the cross section of the corresponding stationary blade as the duct blade is viewed in cross section taken in the perpendicular direction, and a rear portion of each duct blade is shaped such that a tangent plane to a surface of the rear portion located in the rotational direction includes a tangent line extending in parallel to the axis;

the duct housing includes a cylindrical body coupled to the housing body of the fan housing, and a core concentrically disposed inside the cylindrical body;

one end of each of the duct blades is fixed to an inner periphery of the cylindrical body and the other end of each of the duct blades is fixed to an outer periphery of the core;

one or more auxiliary duct blades are provided between two adjacent duct blades in a region in which the rear portion of each duct blade is located, the auxiliary duct blades extending inwardly of the cylindrical body from a peripheral wall portion of the cylindrical body and extending in the axial direction from the outlet port toward the inlet port of the duct housing; and, a length of each auxiliary duct blade in the axial direction is the same as a length of the rear portion of each duct blade in the axial direction.

2. The fan system according to claim 1, wherein an inner peripheral surface of the peripheral wall portion of the cylindrical portion includes first and second surfaces extending in parallel to each other and third and fourth surfaces extending in parallel to each other and perpendicularly to the first and second surfaces; and the one or more auxiliary duct blades extend perpendicularly to the first through fourth surfaces.

3. The fan system according to claim 2, wherein the plurality of auxiliary duct blades are formed integrally with each of the first through fourth surfaces of the cylindrical body, extending in parallel to each other.

4. The fan system according to claim 1, wherein the n is an integer of 3 or more, and all the n axial flow fans have the same shape and all the n-1 ducts have the same shape.

5. The fan system according to claim 2, wherein the n is an integer of 3 or more, and all the n axial flow fans have the same shape and all the n-1 ducts have the same shape.

6. The fan system according to claim 3, wherein the n is an integer of 3 or more, and all the n axial flow fans have the same shape and all the n-1 ducts have the same shape.

* * * * *